US006116456A

United States Patent [19]

Davis

[11] Patent Number: 6,116,456

[45] Date of Patent: Sep. 12, 2000

[54] INSULATED FOOD BOX CONSTRUCTION

[76] Inventor: Robert J. Davis, 117 Lambs Rd., Hurffville, N.J. 08080

[21] Appl. No.: 09/245,644

[22] Filed: Feb. 8, 1999

[51] Int. Cl.[7] ..... B65D 25/24

[52] U.S. Cl. ..... 220/636; 220/524

[58] Field of Search ..... 248/151, 146; 220/636, 629, 628, 377, 524

[56] References Cited

U.S. PATENT DOCUMENTS

| | | | |
|---|---|---|---|
| 995,942 | 6/1911 | Bain . | |
| 1,637,553 | 8/1927 | Coleman | 220/628 |
| 1,924,824 | 8/1933 | Yeager | 220/629 |
| 3,591,194 | 7/1971 | Vega | 280/47.26 |
| 4,581,902 | 4/1986 | Starck et al. | 62/258 |
| 4,671,079 | 6/1987 | Petrantoni | 62/457 |
| 4,934,549 | 6/1990 | Allen | 220/4.24 |
| 5,082,631 | 1/1992 | Lenmark, Sr. et al. | 220/377 |
| 5,598,886 | 2/1997 | Criado-Mellado | 165/254 |
| 5,660,296 | 8/1997 | Greenwich | 220/326 |
| 5,660,299 | 8/1997 | Harvey | 220/524 |

*Primary Examiner*—Stephen Castellano
*Attorney, Agent, or Firm*—Henderson & Sturm LLP

[57] ABSTRACT

An insulated food box construction 10 comprising a receptacle unit 11 including a reinforced generally rectangular receptacle member 20 having an open top, a closure unit 12 including a pair of transparent lid panels 40 hingedly connected to the receptacle member 20 and dimensioned to overlie the open top of the receptacle member 20. Each of the lid panels 40 are provided with a pair of "stay open/stay closed" support arms and a support unit 13 including a pair of pivoted support legs 50 operatively associated with the receptacle member 20 for elevating the receptacle member 20 to a serving height during use.

7 Claims, 1 Drawing Sheet

INSULATED FOOD BOX CONSTRUCTION

BACKGROUND OF THE INVENTION

1. Field of the Invention

The present invention relates to the field of insulated receptacles in general, and in particular to an enlarged transportable insulated food container that can be erected to a serving height at its point of use.

2. Description of Related Art

As can be seen by reference to the following U.S. Pat. Nos. 3,591,194; 4,581,902, 4,671,079; 5,660,296; and 5,598,886, the prior art is replete with myriad and diverse insulated food and beverage containers and receptacles.

While all of the aforementioned prior art constructions are more than adequate for the basic purpose and function for which they have been specifically designed, they are uniformly deficient with respect to their failure to provide a simple, efficient, and practical device to transport large quantities of chilled or heated foodstuffs to a location and then employ a self-contained means to elevate the container to a serving height.

As most party givers are all too well aware, while there are a large number of large capacity insulated coolers available, these devices require the act of bending over repeatedly to remove the contents of the container which continuously exposes the contents of the container to the ambient atmosphere.

As a consequence of the foregoing situation, there has existed a longstanding need for a new and improved type of insulated food box construction that contains a collapsible support system to elevate the food box to a serving height at its point of use, and the provision of such a construction is a stated objective of the present invention.

BRIEF SUMMARY OF THE INVENTION

Briefly stated, the insulated food box container that forms the basis of the present invention comprises in general, a receptacle unit, a closure unit, and a collapsible support unit for elevating the receptacle unit to a serving height at the point of use of the food box and which can be collapsed to facilitate the transport of the insulated food box to and from the point of use.

As will be explained in greater detail further on in the specification, the receptacle unit is provided with an internal support framework that will provide rigidity and support to the walls and floor of the receptacle member in the absence of compartment dividers.

In addition, the upper portion of the support framework will provide a peripheral support surface for each of the spring loaded "stay-open/stay-closed" transparent lid members that comprise the closure unit.

Furthermore, the collapsible support unit comprises a pair of folding support leg members that are pivotally connected on the opposite ends of the receptacle member such that the support legs are retracted in the transport mode of the insulated food box and extended downwardly when the food box is at its intended destination so that the food box is elevated to a convenient serving height that will facilitate access into the interior of the receptacle member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figures 1, 2, 3:
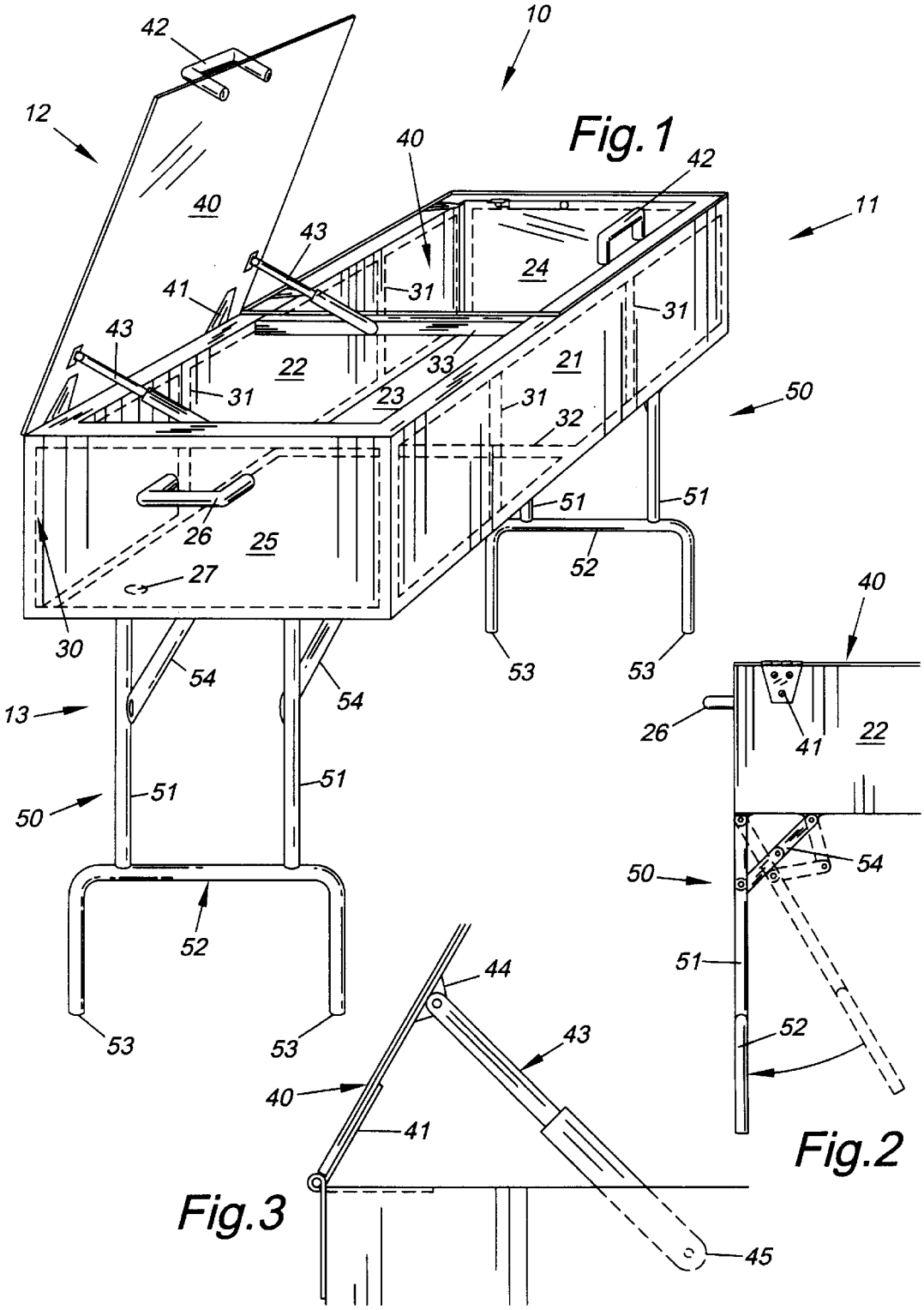
FIG. 1 is a perspective view of the insulated food box construction that forms the basis of the present invention.
FIG. 2 is an isolated detail view of one of the pivoted support leg members.
FIG. 3 is an isolated detail view of the closure unit support system.

As can be seen by reference to the drawings, and in particular to FIG. 1, the insulated food box construction that forms the basis of the present invention is designated generally by the reference number 10. The construction 10 comprises in general, a receptacle unit 11, a closure unit 12, and a support unit 13. These units will now be described in seriatim fashion.

As shown in FIG. 1, the receptacle unit 11 comprises a generally elongated rectangular insulated reinforced receptacle member 20 having elongated front 21, rear 22, and floor 23 panels and a pair of side panels 24, 25. All of the panels are provided with a generally rectangular internal support framework segment designated generally as 30. The front 21 and rear 22 panels are further provided with a pair of equally spaced internal vertical support framework braces 31 and the floor panel 23 is provided with a single internal horizontal support framework brace 32 disposed along the transverse midpoint of the floor panel 23 and a floor drain 27 disposed proximate one end.

Furthermore, all of the support framework segments 30 are joined together to form the overall internal support framework structure that provides rigidity and support to the receptacle member 20 and which is further supplemented by an exposed horizontal support framework brace 33 which extends transversely across the open top of the receptacle member 20 and whose purpose and function will be described presently.

In addition, the receptacle member 20 is further provided with a pair of carrying handles 26 disposed on the exterior of the side panels 24 and 25 to facilitate the transport of the receptacle member 20 from one location to another.

Turning now to FIGS. 1 and 3, it can be seen that the closure unit 12 comprises a pair of transparent lid panels 40 hingedly connected on one end as at 41 to the rear panel 22 of the receptacle member 20. The other end of the lid panels 40 are provided with lifting handles 42.

In addition, the lid panels 40 are further dimensioned to completely cover the opening in the top of the receptacle member 20. The adjacent sides of the lid members 40 will rest upon the exposed horizontal support framework brace 33 when the lid panels 40 are in their closed position.

Furthermore, each of the transparent lid panels 40 are provided with a pair of collapsible support arms 43 which are operatively connected on one end 44 to the lid panel 40 and operatively connected on the other end 45 to the exposed horizontal brace 33 and one of the side panels 24 or 25, respectively. The support arms 43 are of the conventional "stay open-stay closed" spring biased variety. Once the support arm 43 has passed the midpoint of its travel in either the open or closed direction, the spring biasing effect will force the lid panel 40 to the full extent of either its opening or closing movement.

Turning now to FIGS. 1 and 2, it can be seen that the collapsible support unit 13 comprises a pair of support leg members 50 which are pivotally secured on their upper end to the opposite ends of the floor panel 23. Each of the support leg members 50 includes a pair of elongated support rods 51 which are operatively connected on their lower end of an inverted U-shaped foot element 52 having two downwardly depending foot elements 53. The upper end of each of the support rods 51 are further provided with a collapsible brace linkage 54 which may be locked in place to maintain the support leg members 50 in their extended position when the receptacle member 20 is disposed at its serving height.

At this juncture, it should be appreciated that the transparent lid panels 40 are provided to not only allow the user to visually inspect the contents of the receptacle member 20, but also permit the user to only open the side of the receptacle member 20 that contains a desired item, thereby minimizing the loss of the ambient air conditions within the receptacle member 20.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An insulated food box construction comprising:

a receptacle unit including a reinforced generally rectangular insulated receptacle member having a front panel, a rear panel, two side panels, and a floor panel that are joined together to form an open top receptacle member;

a closure unit including; a pair of lid panels hingedly connected on one end to the rear panel of the receptacle member wherein at least one of said lid panels is transparent, and a support unit including a plurality of support leg members having an upper end pivotally associated with the floor panel of the receptacle member for maintaining the receptacle member at an elevated serving height position during use.

2. The food box construction as in claim 1 wherein both of said lid panels are transparent.

3. The food box construction as in claim 1 wherein each of the receptacle member panels are provided with a generally rectangular internal support framework segment.

4. The food box construction as in claim 3 wherein the receptacle member further includes:

an exposed horizontal support framework brace which extends transversely across the open top of the receptacle member.

5. The food box construction as in claim 4 wherein the exposed horizontal support framework brace provides a support surface for the adjacent sides of the lid panels in their closed position.

6. The food box construction as in claim 4 wherein each of the lid panels is provided with a pair of collapsible support arms.

7. The food box construction as in claim 6 wherein said collapsible support arms are of the "stay open/stay closed" variety.

* * * * *